US008989410B2

(12) United States Patent
Hebenstreit

(10) Patent No.: US 8,989,410 B2
(45) Date of Patent: Mar. 24, 2015

(54) COMPACT BONE CONDUCTION AUDIO TRANSDUCER

(71) Applicant: Google Inc., Mountain View, CA (US)

(72) Inventor: Joseph John Hebenstreit, San Francisco, CA (US)

(73) Assignee: Google Inc., Mountain View, CA (US)

( * ) Notice: Subject to any disclaimer, the term of this patent is extended or adjusted under 35 U.S.C. 154(b) by 172 days.

(21) Appl. No.: 13/657,824

(22) Filed: Oct. 22, 2012

(65) Prior Publication Data

US 2014/0112503 A1 Apr. 24, 2014

(51) Int. Cl.

| | |
|---|---|
| ***H04R 25/00*** | (2006.01) |
| ***H04R 1/00*** | (2006.01) |
| ***H04R 9/06*** | (2006.01) |
| ***H04R 11/02*** | (2006.01) |
| ***H04R 31/00*** | (2006.01) |

(52) U.S. Cl.

CPC ..... *H04R 1/00* (2013.01); *H04R 31/00* (2013.01); *Y10T 29/49005* (2013.01)

USPC ..... 381/151; 381/162; 381/326; 381/417

(58) Field of Classification Search

CPC ..... H04R 11/00; H04R 11/02; H04R 11/04; H04R 11/14; H04R 2460/13; G02C 11/00; G02C 11/06; G02C 11/10; G02B 2027/0178

USPC ..... 381/151, 162, 326, 417

See application file for complete search history.

(56) References Cited

U.S. PATENT DOCUMENTS

| | | | | |
|---|---|---|---|---|
| 2,000,165 | A * | 5/1935 | Erickson | 381/151 |
| 2,459,325 | A | 10/1944 | Knowles | |
| 3,134,861 | A | 5/1964 | Dempsey et al. | |
| 7,809,147 | B2 | 10/2010 | Giannetti | |
| 7,869,610 | B2 | 1/2011 | Jayanth et al. | |
| 2003/0048913 | A1 | 3/2003 | Lee et al. | |

(Continued)

FOREIGN PATENT DOCUMENTS

| | | | |
|---|---|---|---|
| CA | 2 578 083 | A1 | 3/2006 |
| JP | 2012186684 | A | 9/2012 |
| KR | 1020070073738 | A | 7/2007 |

OTHER PUBLICATIONS

Written Opinion of International Application No. PCT/US2013/064338 dated Jan. 22, 2014 (mailed Jan. 23, 2014).

(Continued)

*Primary Examiner* — Matthew Eason

(74) *Attorney, Agent, or Firm* — McDonnell Boehnen Hulbert & Berghoff LLP

(57) ABSTRACT

A bone conduction transducer for a wearable computing system is provided. The bone conduction transducer includes a magnetic diaphragm configured to vibrate in response to a time-changing magnetic field generated by an electromagnetic coil operated according to electrical input signals. The magnetic diaphragm is elastically suspended over the electromagnetic coil to allow excursion toward and away from the coil by a pair of cantilevered leaf springs projected from opposing sides of the transducer to connect to opposing sides of the magnetic diaphragm. The bone conduction transducer is included in the wearable computing system to be worn against a bony structure of the wearer that allows acoustic signals to propagate to the wearer's inner ear and achieve sound perception in response to vibrations in the bone conduction transducer.

16 Claims, 8 Drawing Sheets

(56) References Cited

U.S. PATENT DOCUMENTS

| | | | | |
|---|---|---|---|---|
| 2008/0292118 | A1 | 11/2008 | Fukuda | |
| 2010/0110368 | A1* | 5/2010 | Chaum | 351/158 |
| 2010/0149073 | A1 | 6/2010 | Chaum et al. | |
| 2012/0008816 | A1 | 1/2012 | Liu et al. | |
| 2012/0155697 | A1 | 6/2012 | Liu et al. | |
| 2012/0230529 | A1* | 9/2012 | Schumaier et al. | 381/326 |
| 2012/0244917 | A1 | 9/2012 | Hosoi et al. | |

OTHER PUBLICATIONS

International Search Report mailed Jan. 23, 2014, issued in corresponding International Application No. PCT/US2013/064338 (3 pages).

* cited by examiner

COMPACT BONE CONDUCTION AUDIO TRANSDUCER

BACKGROUND

Computing devices such as personal computers, laptop computers, tablet computers, cellular phones, and countless types of Internet-capable devices are increasingly prevalent in numerous aspects of modern life. Over time, the manner in which these devices are providing information to users is becoming more intelligent, more efficient, more intuitive, and/or less obtrusive.

The trend toward miniaturization of computing hardware, peripherals, as well as of sensors, detectors, and image and audio processors, among other technologies, has helped open up a field sometimes referred to as "wearable computing." In the area of image and visual processing and production, in particular, it has become possible to consider wearable displays that place a "near-eye display" element close enough to a wearer's eye(s) such that a displayed image is perceived by the wearer.

Wearable computing systems can be configured to be worn proximate a wearer's head to allow for interfacing with the wearer's audible and/or visual senses. For example, a wearable computing system can be implemented as a helmet or a pair of glasses. To transmit audio signals to a wearer, a wearable computing system can function as a hands-free headset or as headphones, employing speakers to produce sound. Audio transducers are employed in microphones and speakers. A typical audio transducer converts electrical signals to acoustic waves by sending the electrical signals through a coil to produce a time-varying magnetic field which operates to move a small magnet connected to a membrane. The time-changing magnetic fields vibrate the magnet, which vibrates the membrane, and results in sound waves traveling through air. An acoustic transducer can also translate sound waves to electrical signals by a similar process using a pressure sensitive membrane to create a time-changing magnetic field that produces an electrical signal in a coil of wire, such as in a microphone.

Sound perception in the biological realm, such as in human ears, also involves converting acoustic waves to electrical signals. For conventional sound perception, incoming acoustic waves are directed by the outer ear toward the ear canal where the tympanic membrane (ear drum) is stimulated to vibrate in accordance with the received acoustic pressure wave. The pressure wave information is then translated and frequency shifted by three small ossicles bones in the middle ear. The ossicles bones mechanically stimulate another membrane separating the fluid-filled chamber of the inner ear, which includes the cochlea. Hairs lining the interior of the cochlea act as frequency-specific mechanotransducers when stimulated by the pressure wave transmitted through the fluid in the cochlea to activate neurons that send signals to the brain allowing for perception of sound.

Bone conduction transducers create sound perception by directly stimulating the ossicles bones in the middle ear and effectively bypassing the outer ear. Bone conduction transducers couple to a bony surface on the skull or jaw, such as the mastoid bone surface behind the ear, to create vibrations that propagate to the ossicles bones, and thereby allow for sound perception without directly vibrating the tympanic membrane. A bone conduction transducer transmits vibrations to the inner ear by a vibrating anvil placed on a bony structure of the skull or jaw. Such a bone conduction transducer can include an anvil suitable for making contact with a bony portion of the head can be mounted to a transducer, which can vibrate the anvil according to received electrical signals.

SUMMARY

A bone conduction transducer for a wearable computing system is disclosed. The bone conduction transducer can include a magnetic diaphragm configured to vibrate in response to a time-changing magnetic field generated by an electromagnetic coil operated according to electrical input signals. The magnetic diaphragm is elastically suspended over the electromagnetic coil to allow excursion toward and away from the coil by a pair of cantilevered leaf springs projected from opposing sides of the transducer to connect to opposing sides of the magnetic diaphragm. The bone conduction transducer is included in the wearable computing system to be arranged against a bony structure of a wearer's head. During operation, vibrations in the vibration transducer create vibrations that propagate through the wearer's jaw and/or skull to stimulate the wearer's inner ear and achieve sound perception in response to vibrations in the bone conduction transducer.

Some embodiments of the present disclosure provide a transducer including an electromagnet, a magnetic diaphragm, and a pair of cantilevered flexible support arms. The electromagnet can include a conductive coil surrounding a central core, wherein the conductive coil is configured to be driven by an electrical input signal to generate magnetic fields. The magnetic diaphragm can be configured to mechanically vibrate in response to the generated magnetic fields. The pair of cantilevered flexible support arms can elastically couple the magnetic diaphragm to a frame. The frame can be connected to the electromagnet such that the magnetic diaphragm vibrates with respect to the frame when the electromagnet is driven by the electrical input signal. The pair of cantilevered flexible support arms can be connected to opposing sides of the magnetic diaphragm and each of the pair of cantilevered flexible support arms can extend adjacent respective opposing sides of the magnetic diaphragm free of connection to either of the pair of cantilevered support arms.

Some embodiments of the present disclosure provide a wearable computing system including a support structure, an audio interface, and a vibration transducer. The support structure can include one or more portions configured to contact a wearer. The audio interface can be for receiving an audio signal. The vibration transducer can include an electromagnet, a magnetic diaphragm, and a pair of cantilevered flexible support arms. The electromagnet can include a conductive coil surrounding a central core, wherein the conductive coil is configured to be driven by an electrical input signal to generate magnetic fields. The magnetic diaphragm can be configured to mechanically vibrate in response to the generated magnetic fields. The pair of cantilevered flexible support arms can elastically couple the magnetic diaphragm to a frame. The frame can be connected to the electromagnet such that the magnetic diaphragm vibrates with respect to the frame when the electromagnet is driven by the electrical input signal. The pair of cantilevered flexible support arms can be connected to opposing sides of the magnetic diaphragm and each of the pair of cantilevered flexible support arms can extend adjacent respective opposing sides of the magnetic diaphragm free of connection to either of the pair of cantilevered support arms. The vibration transducer can be embedded in the support structure and configured to vibrate based on the audio signal so as to provide information indicative of the audio signal to the wearer via a bone structure of the wearer.

Some embodiments of the present disclosure provide a method of assembling a vibration transducer. The method can include arranging a first flexible support arm, arranging a second support arm, and laser welding the first and second flexible support arms. The first flexible support arm can have a first end and a second end. Arranging the first flexible support arm can be carried out such that: the first end is positioned over a first mounting surface of a magnetic diaphragm; and the second end is positioned over a first strut or sidewall of a frame of the vibration transducer. Overlapping regions of the first and second ends of the first flexible support arm can overlap the first mounting surface of the magnetic diaphragm and the first strut or sidewall of the frame, respectively. The second flexible support arm can have a first end and second end. Arranging the second flexible support arm can be carried out such that: the first end is positioned over a second mounting surface of the magnetic diaphragm; and the second end is positioned over a second strut or sidewall of the frame. The second mounting surface and the first mounting surface can be on opposing sides of the magnetic diaphragm. Overlapping regions of the first and second ends of the second flexible support arm can overlap the second mounting surface of the magnetic diaphragm and the second strut or sidewall of the frame, respectively. Laser welding the first and second flexible support arms can include directing a laser source sufficient to generate heat for laser welding to the respective overlapping regions of the first and second flexible support arms such that one or more laser spot welds are formed to connect the magnetic diaphragm and the frame via the first and second flexible support arms and thereby elastically suspend the magnetic diaphragm with respect to the frame.

These as well as other aspects, advantages, and alternatives, will become apparent to those of ordinary skill in the art by reading the following detailed description, with reference where appropriate to the accompanying drawings.

DETAILED DESCRIPTION

Figure 1A:
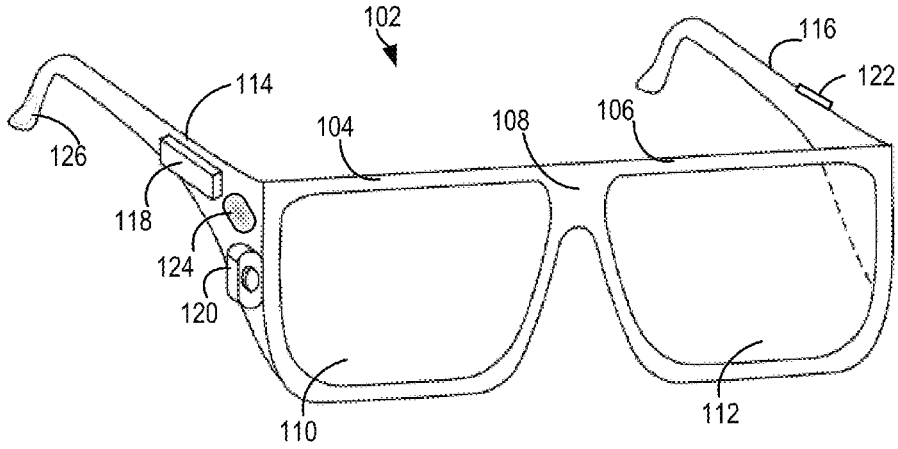
FIG. 1A illustrates an example wearable computing system.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. Overview

A bone conduction transducer is designed to receive audio signals and produce corresponding oscillations in the transducer's magnetic diaphragm. When placed against a bony structure of the head, the oscillating diaphragm creates vibrations in the skull that propagate to the inner ear and cause sound to be perceived. An electromagnet is formed by wire coiled around a core and operated according to the input signals to produce a time changing magnetic field sufficient to vibrate the diaphragm. Permanent magnets are located on opposing sides of the electromagnet to bias the diaphragm and/or magnetize ferromagnetic components of the diaphragm such that the diaphragm can be both attracted and repelled by the variations of the electromagnet. The diaphragm is elastically suspended over the electromagnet to allow for translation due to the combined magnetic forces acting on according to the input signals. In some embodiments disclosed herein, the diaphragm is elastically suspended by a pair of cantilevered support arms.

The present disclosure presents an example configuration for a bone conduction transducer in a compact form factor while maximizing the length of flexible components used to elastically suspend the diaphragm. An example embodiment is disclosed with cantilevered flexible support arms arranged to extend from one side of the transducer to an opposing side, across the longest the dimension of the bone conduction transducer. In comparison to a transducer that with flexible components connected to each corner of a suspended diaphragm, or with flexible components wound adjacent a shortened side of the diaphragm, the cantilevered support arms described herein maximize the available length of flexible materials used to elastically suspend the diaphragm. In other words, by suspending the diaphragm by flexible support arms that are cantilevered to extend adjacent the length of the diaphragm, the elasticity of the bone conduction transducer is increased without extending the length of the transducer significantly beyond the size of the diaphragm itself. The increased length of the flexible support arms is achieved within a relatively compact form factor by cantilevering the support arms from opposing sides of the transducer such that each cross opposing sides of the diaphragm and connect to opposing sides of the diaphragm.

A bone conduction transducer with cantilevered support arms as described herein provides a transducer designer with increased options for tuning the frequency and/or amplitude responsiveness of the transducer. The frequency and/or amplitude responsiveness of a transducer is influenced, at least in part, by the flexibility and/or frequency response of the flexible materials elastically suspending the diaphragm with respect to the electromagnet. Thus, increasing the length of the support arms also increases the ability of designers to tune the responsiveness of the transducer by adjusting the physical dimensions (e.g., width, thickness, etc.) and/or material selection (e.g., steel, aluminum, plastic, composite resins, etc.). Because longer support arms provide greater influence on the frequency and/or amplitude responsiveness of the transducer. Lengthy flexible supports were previously associated with large form factor transducers where flexible supports were connected to extend away from each side of a diaphragm, such that increased length of the flexible supports resulted in increased form factor length for the transducer. As a result of the present disclosure, a bone conduction transducer designer is no longer forced to choose between a small form factor design, and a broad selection of tunable frequency and/or amplitude responsiveness.

Further, because only two support arms are employed, as opposed to four supports, with one on each corner, the support arms are connected to opposing corners of the rectangular diaphragm. Connecting the support arms to opposing corners balance the torque on the diaphragm generated by one or the other of the support arms.

II. Examples of Wearable Computing Systems

FIG. 1A illustrates an example wearable computing system. In FIG. 1A, the wearable computing system takes the form of a head-mountable device (HMD) 102 (which may also be referred to as a head-mounted display). It is noted, however, that the present disclosure includes implementations of other wearable computing system form factors, such as helmets, hats, visors, headbands, adhesive patches, etc. As illustrated in FIG. 1A, the head-mountable device 102 has lenses 110, 112 mounted in lens-frames 104, 106. The lenses 110, 112 can optionally be vision-correcting lenses, for example. A center frame support 108 couples the lens-frames 104, 106 and can be configured to be compatible with a wearer's nose to allow the HMD 102 to be supported on a wearer's face. The HMD 102 also includes extending side-arms 114, 116 configured to be compatible with a wearer's ears to allow the HMD 102 to be supported on the wearer's face. The extending side-arms 114, 116 can be connected by a hinge to each of the lens-frames 104, 106 from a side opposite the center frame support 108.

One or both of the lenses 110, 112 can be formed of a material suitable for displaying a projected image or graphic. The lenses 110, 112 can also be substantially transparent to allow a wearer to see through the lens element. Combining these features of the lenses 110, 112 can facilitate an augmented reality or heads-up display system where a projected image or graphic is superimposed over a real-world view, as perceived by the wearer through the lenses 110, 112.

The HMD 102 can also include an on-board computing system 118, a video camera 120, a sensor 122, and a finger-operable touch pad 124. The on-board computing system 118 is shown to be positioned on the extending side-arm 114 of the head-mounted device 102; however, the on-board computing system 118 can be situated on other parts of the HMD 102 or can be positioned remote from the HMD 102 (e.g., a computing system can be wire-connected or wirelessly-connected to the HMD 102). The on-board computing system 118 can be configured to process signals from a content source to create driver signals to operate user-interface elements of the HMD 102 to portray information to the wearer, such as via the lenses 110, 112. The on-board computing system 118 can be configured to receive and analyze data from the video camera 120, the finger-operable touch pad 124, and/or other sensory devices, user interfaces, etc. The on-board computing system 118 can include, for example, a processor executing instructions stored on a memory to implement the functions described.

The video camera 120 is positioned on the extending side-arm 114 of the head-mounted device 102, but can also be situated in another location on the HMD 102. The video camera 120 can be configured to capture images at various resolutions and/or frame rates. In some instances the video camera 120 can be similar in some respects to video cameras employed in other small form-factor environments, such as cameras used in cell phones, tablets, and webcams, for example.

Further, although FIG. 1A illustrates one video camera 120, more video cameras can be included. For example, each can be configured to capture the same view, or to capture different views. For example, the video camera 120 can be forward-facing to capture at least a portion of the view perceived by the wearer. The forward-facing image captured by the video camera 120 can then be used to generate an augmented reality where computer generated images appear to interact with the real-world view perceived by the wearer.

A sensor 122 is shown on the extending side-arm 116 of the HMD 102; however, the sensor 122 can be positioned on other parts of the HMD 102. The sensor 122 can include, for example, a gyroscope and/or an accelerometer to provide inertial motion sensitivity as an input to the computing system 118. The sensor 122 can additionally or alternatively include sensors configured to detect environmental features and/or aspects of a wearer such as a microphone, a thermometer, an air monitor, solar detector, perspiration sensor, etc.

The finger-operable touch pad 124 is shown on the extending side-arm 114 of the HMD 102. However, the finger-operable touch pad 124 can be positioned on other parts of the HMD 102. Further, more than one finger-operable touch pad can be included on the HMD 102. The finger-operable touch pad 124 can be used by a wearer to input commands. The finger-operable touch pad 124 can sense a presence, position, and/or movement of a finger in contact with, or at least proximate, the finger-operable touch pad 124. The finger-operable touch pad 124 can operate via capacitive sensing, resistance sensing, or a surface acoustic wave process, among other possibilities. The finger-operable touch pad 124 can be capable of sensing finger movement in a direction parallel or planar to the pad surface, in a direction normal to the pad surface, or both, and can also be capable of sensing a level of pressure applied to the pad surface. The finger-operable touch pad 124 can be formed of one or more translucent or transparent insulating layers and one or more translucent or transparent conducting layers. Edges of the finger-operable touch pad 124 can be formed to have a raised, indented, or roughened surface, so as to provide tactile feedback to a user when the user's finger reaches the edge, or other area, of the finger-operable touch pad 124. If more than one finger-operable touch pad is present, each finger-operable touch pad can be operated independently, and can provide a different function.

A vibration transducer 126 is embedded in the right extending side-arm 114. The vibration transducer 126 functions as a bone-conduction transducer (BCT), which can be arranged such that when the HMD 102 is worn, the vibration transducer 126 is positioned to contact the wearer behind the wearer's ear. Additionally or alternatively, the vibration transducer 126 can be arranged such that the vibration transducer 126 is positioned to contact a front of the wearer's ear. In an example embodiment, the vibration transducer 126 can be positioned to couple to a specific location of the wearer's ear and/or skull, such as the tragus of the ear and/or the mastoid region of the skull.

The HMD 102 includes an audio interface (not shown) that is configured to receive an audio signal from a source of audio content and provide suitable electrical signals to the vibration transducer 126 to drive the vibration transducer 126. For instance, in an example embodiment, the HMD 102 can include a microphone, an internal audio playback device such as an on-board computing system that is configured to play digital audio files, and/or an audio interface to an auxiliary audio playback device, such as a portable digital audio player, smartphone, home stereo, car stereo, and/or personal computer. The connection to such an auxiliary audio playback device can be a tip, ring, sleeve (TRS) connector, or can take another form. Other audio sources and/or audio interfaces can also be employed to generate electrical driver signals to the vibration transducer 126.

Figure 1B:
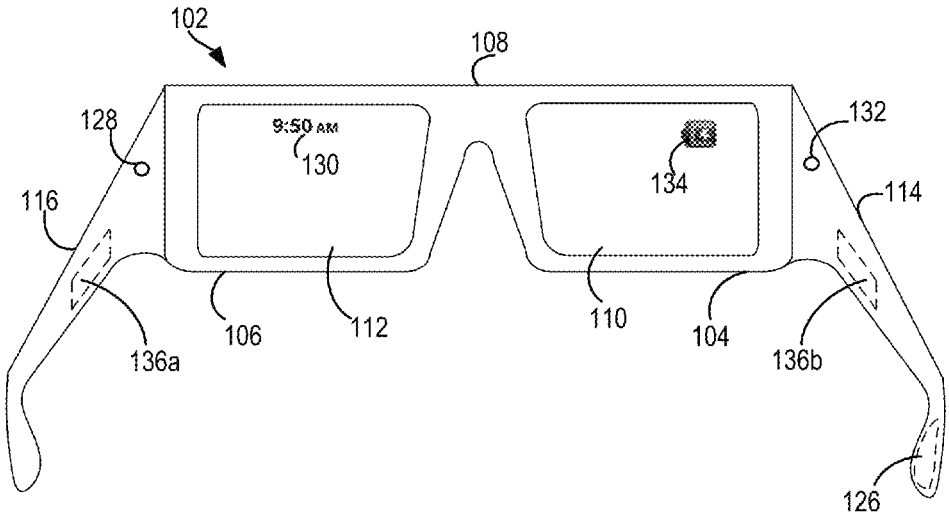
FIG. 1B illustrates an alternate view of the wearable computing system illustrated in FIG. 1A.

FIG. 1B illustrates an alternate view of the wearable computing device illustrated in FIG. 1A. As shown in FIG. 1B, the lens elements 110, 112 can act as display elements. The HMD 102 can include a projector 128 coupled to an inside surface of the extending side-arm 116 and configured to project a display 130 onto an inside surface of the lens element 112. Additionally or alternatively, a second projector 132 can be coupled to an inside surface of the extending side-arm 114 and configured to project a display 134 onto an inside surface of the lens element 110.

The lens elements 110, 112 can be configured to act as a combiner in a light projection system and can include a coating that reflects light projected onto them from the projectors 128, 132. In some embodiments, a reflective coating is not used (e.g., when the projectors 128, 132 are scanning laser devices).

In alternative embodiments, other types of display elements can also be used. For example, the lens elements 110, 112 themselves may include: a transparent or semi-transparent matrix display, such as an electroluminescent display or a liquid crystal display. One or more optical waveguides or other optical elements can be incorporated in the lens elements 110, 112 or otherwise situated on the HMD 102 to deliver an in focus near-to-eye image to the wearer. A corresponding display driver can be disposed within the frame elements 104, 106 for driving such a matrix display (e.g., for providing electrical signals suitable for operating the projectors 128, 132 and/or electroluminescent display, etc.). Alternatively or additionally, a laser or LED source and scanning system can be used to draw a matrix display directly onto the retina of the wearer's eye(s).

The HMD 102 can optionally include vibration transducers 136*a*, 136*b*, embedded in the left side-arm 116 and the right side-arm 114, respectively. The vibration transducers 136*a*, 136*b* can be an alternative to, or in addition to, the vibration transducer 126. The vibration transducers 136*a*, 136*b* can be situated on the HMD 102 to contact the wearer near the wearer's temple.

Figure 1C:
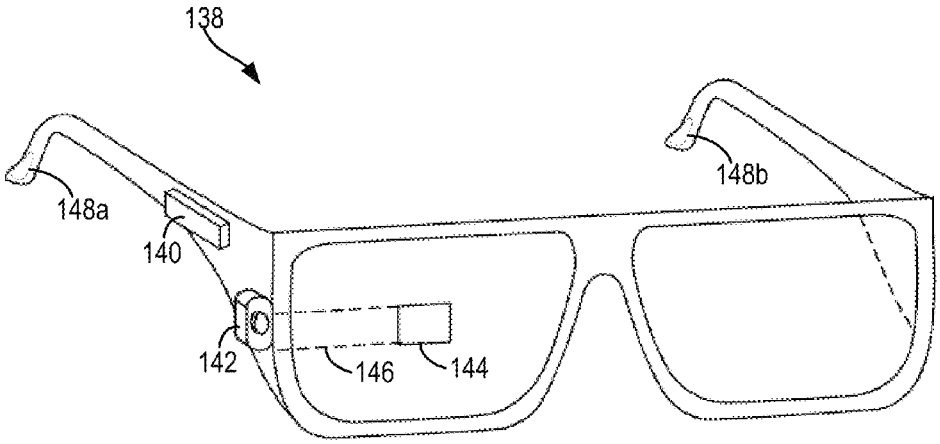
FIG. 1C illustrates another example wearable computing system.

FIG. 1C illustrates another example wearable computing system which takes the form of a head-mountable device ("HMD") 138. The HMD 138 can include frame elements and side-arms similar to the frame and extending side arms described in connection with FIGS. 1A and 1B above. The HMD 138 can additionally include an on-board computing system 140 and a video camera 142, similar to the computing system and video camera(s) described in connection with FIGS. 1A and 1B above. The video camera 142 is shown mounted on a frame of the HMD 138. However, the video camera 142 can be mounted at other positions on the HMD 138 as well.

As shown in FIG. 1C, the HMD 138 can include a single display 144 which can be coupled to the device. The display 144 can be formed on one of the lens elements of the HMD 138, which can be similar to the lens elements described in connection with FIGS. 1A and 1B above. The lenses in the HMD 138 can be configured to overlay computer-generated visually perceivable graphics in the wearer's view of the physical world. The display 144 is shown to be situated near the center of the lens of the HMD 138, however, the display 144 can be situated in other positions, such as near a periphery of the lens(es), for example. The display 144 can be controlled ("driven") via the computing system 140. An optical waveguide 146 can optionally convey optical content to the display 144 from an image-generating region included in the frame of the HMD 138.

The HMD 138 includes vibration transducers 148*a-b* embedded in the left and right side-arms of the HMD 138. Each vibration transducer 148*a-b* functions as a bone-conduction transducer, and is arranged such that when the HMD 138 is worn, the vibration transducer is positioned to contact a wearer at a location behind the wearer's ear. Additionally or alternatively, the vibration transducers 148*a-b* can be situated on the HMD 138 such that the vibration transducers 148*a-b* are positioned to contact the front of the wearer's ear.

Further, in an embodiment with two vibration transducers 148*a-b*, the vibration transducers can be separately driven to provide stereo audio (e.g., left and right stereo channels are conveyed via the two vibration transducers 148*b* and 148*a*, respectively). As such, the HMD 138 can include at least one audio interface (not shown) for receiving audio signals from a source of audio content and providing suitable electrical driver signals to the vibration transducers 148*a-b*.

Figure 1D:
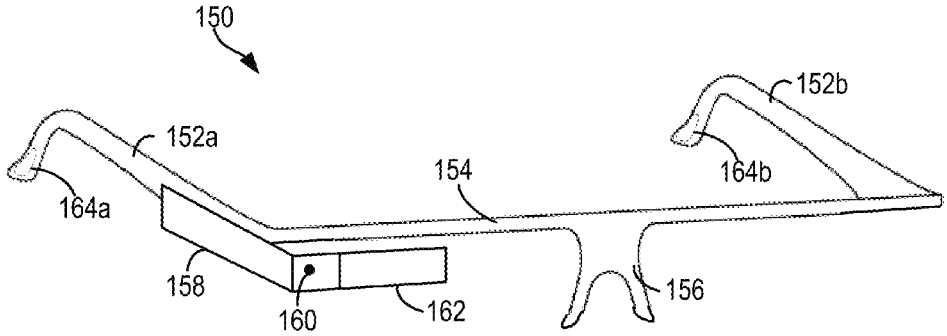
FIG. 1D illustrates another example wearable computing system.

FIG. 1D illustrates another example wearable computing system which takes the form of a head-mountable device ("HMD") 150. The HMD 150 can include side-arms 152*a-b*, a center frame support 154, and a nose bridge 156. The center frame support 154 connects the side-arms 152*a-b*. The nose bridge 156 and the side-arms 152*a-b* can be configured to rest upon a wearer's nose and ears, respectively, to allow the HMD 150 to be mountable on a wearer's face. The HMD 150 does not include lens-frames containing lens elements. The HMD 150 can include an on-board computing system 158 and a video camera 160, such as the computing systems and video camera(s) described in connection with FIGS. 1A-1C above.

The HMD 150 can include a display device 162 that can be coupled to one of the side-arms 152*a-b* or the center frame support 154. The display device 162 is shown in FIG. 1D coupled to the side-arm 152*a* for purposes of illustration. The display device 162 can be similar to the display described in connection with FIG. 1C above, and can include, for example, electroluminescent and/or liquid crystal components to provide a matrix display of individually programmable pixels. In some examples, the display device 162 is configured to overlay computer-generated graphics on the wearer's view of the physical world. In one example, the display device 162 can be coupled to the inner side of the extending side-arm 152*a* (i.e., the side exposed to a portion of a wearer's head). The display device 162 can be positioned in front of or proximate to a wearer's eye when the HMD 150 is worn. For example, the display device 162 can be positioned below the center frame support 154, as shown in FIG. 1D, such that the display device 162 is situated in a line of sight of a wearer's eye while the nose bridge 156 rests on the wearer's nose.

Vibration transducers 164*a-b* are located on the left and right side-arms of HMD 150. The vibration transducers 164*a-b* can be situated in the side-arms 152*a-b* of the HMD 150 similarly to the vibration transducers 148*a-b* on HMD 138 discussed in connection with FIG. 1D above.

The arrangements of the vibration transducers of FIGS. 1A-1D are not limited to those that are described and shown with respect to FIGS. 1A-1D. Additional or alternative vibration transducers can be embedded in a head-mountable device or other wearable computing system. In some embodiments of the present disclosure, a wearable computing system includes vibration transducers positioned at one or more locations at which the wearable computing system contacts the wearer's head. In some examples, vibration transducers are situated on the wearable computing system to provide vibrational coupling to a bony structure of the wearer's head to allow acoustic signals to propagate through the wearer's jaw and/or skull to stimulate the wearer's inner ear and thereby allow for sound perception based on the operation of the vibration transducers.

Figure 1E:
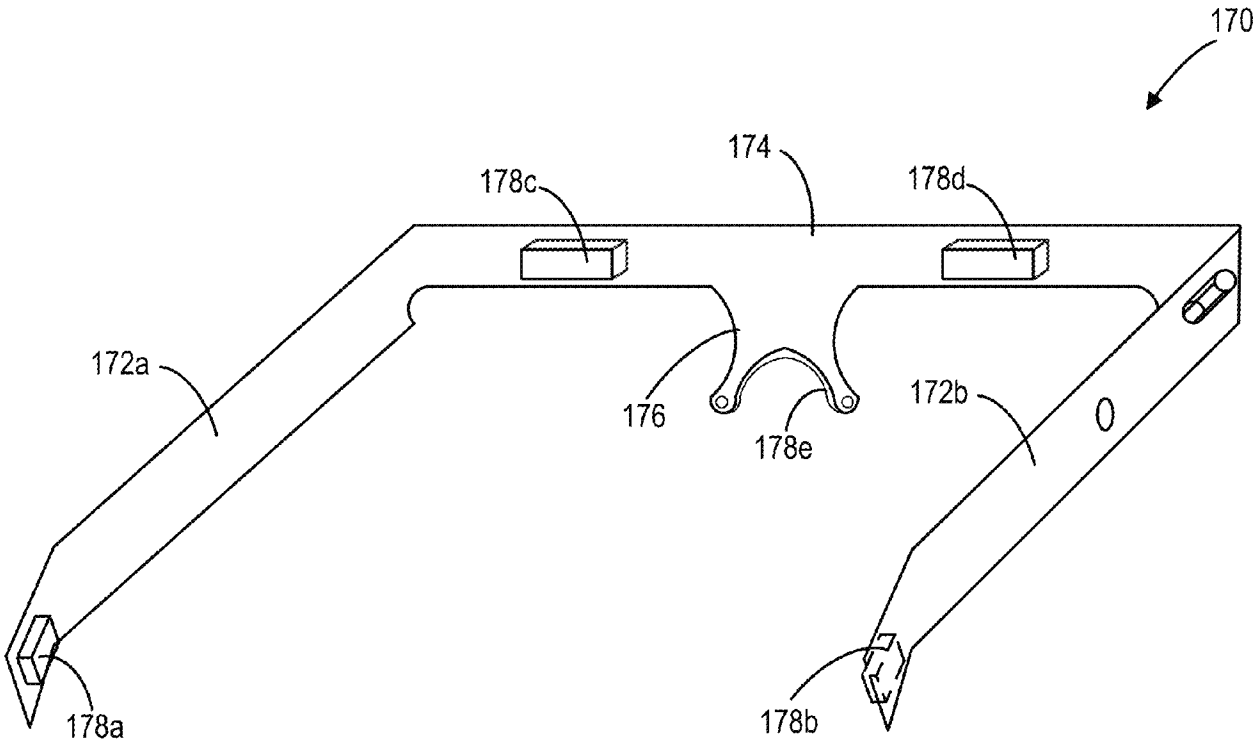
FIG. 1E is a simplified illustration of an example head-mountable device configured for bone-conduction audio

FIG. 1E is a simplified illustration of an example head-mountable device ("HMD") 170 configured for bone-conduction audio. As shown, the HMD 170 includes an eyeglass-style frame comprising two side-arms 172*a-b*, a center frame support 174, and a nose bridge 176. The side-arms 172*a-b* are connected by the center frame support 174 and arranged to fit behind a wearer's ears. The HMD 170 includes vibration transducers 178*a-e* that are configured to function as bone-conduction transducers. In some examples, one or more of the vibration transducers 178*a-e* vibrate anvils configured to interface with a bony portion of the wearer's head to thereby convey acoustic signals through the wearer's jaw and/or skull when the vibration transducers 178*a-e* vibrate with respect to the frame of the HMD 170. Additionally or alternatively, it is noted that bone conduction audio can be conveyed to a wearer through vibration of any portion of the HMD 170 that contacts the wearer so as to transmit vibrations to the wearer's bone structure. For example, in some embodiments of the present disclosure, one or more of the vibration transducers 178*a-e* can operate without driving an anvil, and instead couple to the frame of the HMD 170 to cause the side-arms 172*a-b*, center frame support 174, and/or nose bridge 176 to vibrate against the wearer's head.

The vibration transducers 178*a-e* are securely connected to the HMD 170 and can optionally be wholly or partially embedded in the frame elements of the HMD 170 (e.g., the side-arms 172*a-b*, center frame support 174, and/or nose bridge 176). For example, vibration transducers 178*a*, 178*b* can be embedded in the side-arms 172*a-b* of HMD 170. In an example embodiment, the side-arms 172*a-b* are configured such that when a wearer wears HMD 170, one or more portions of the eyeglass-style frame are configured to contact the wearer at one or more locations on the side of the wearer's head. For example, side-arms 172*a-b* can contact the wearer at or near the wearer's ear and the side of the wearer's head. Accordingly, vibration transducers 178*a*, 178*b* can be embedded on the inward-facing side (toward the wearer's head) of the side-arms 172*a-b* to vibrate the wearer's bone structure and transfer vibration to the wearer via contact points on the wearer's ear, the wearer's temple, or any other point where the side-arms 172*a-b* contact the wearer.

Vibration transducers 178*c*, 178*d* are embedded in the center frame support 174 of HMD 170. In an example embodiment, the center frame support 174 is configured such that when a wearer wears HMD 170, one or more portions of the eyeglass-style frame are configured to contact the wearer at one or more locations on the front of the wearer's head. Vibration transducers 178*c*, 178*d* can vibrate the wearer's bone structure, transferring vibration via contact points on the wearer's eyebrows or any other point where the center frame support 404 contacts the wearer. Other points of contact are also possible.

In some examples, the vibration transducer 178*e* is embedded in the nose bridge 176 of the HMD 170. The nose bridge 176 is configured such that when a user wears the HMD 170, one or more portions of the eyeglass-style frame are configured to contact the wearer at one or more locations at or near the wearer's nose. Vibration transducer 178*e* can vibrate the wearer's bone structure, transferring vibration via contact points between the wearer's nose and the nose bridge 176, such as points where the nose bridge 176 rests on the wearer's face while the HMD 170 is mounted to the wearer's head.

When there is space between one or more of the vibration transducers 178*a-e* and the wearer, some vibrations from the vibration transducer can also be transmitted through air, and thus may be received by the wearer over the air. That is, in addition to sound perceived due to bone conduction, the wearer may also perceive sound resulting from acoustic waves generated in the air surrounding the vibration transducers 178*a-e* which reach the wearer's outer ear and stimulate the wearer's tympanic membrane. In such an example, the sound that is transmitted through air and perceived using tympanic hearing can complement sound perceived via bone-conduction hearing. Furthermore, while the sound transmitted through air can enhance the sound perceived by the wearer, the sound transmitted through air can be sufficiently discreet as to be unintelligible to others located nearby, which can be due in part to a volume setting.

In some embodiments, the vibration transducers 178*a-e* are embedded in the HMD 170 along with a vibration isolating layer (not shown) in the support structure of the HMD 170 (e.g., the frame components). For example, the vibration transducer 178*a* can be attached to a vibration isolation layer, and the vibration isolation layer can be connected to the HMD 170 frame (e.g., the side-arms 172*a-b*, center frame support 174, and/or nose bridge 176). In some examples, the vibration isolating layer is configured to reduce audio leakage to a wearer's surrounding environment by reducing the amplitude of vibrations transferred from the vibration transducers to air in the surrounding environment, either directly or through vibration of the HMD 170 frame components.

III. Remotely-Controlled Wearable Computing Systems

Figure 2:
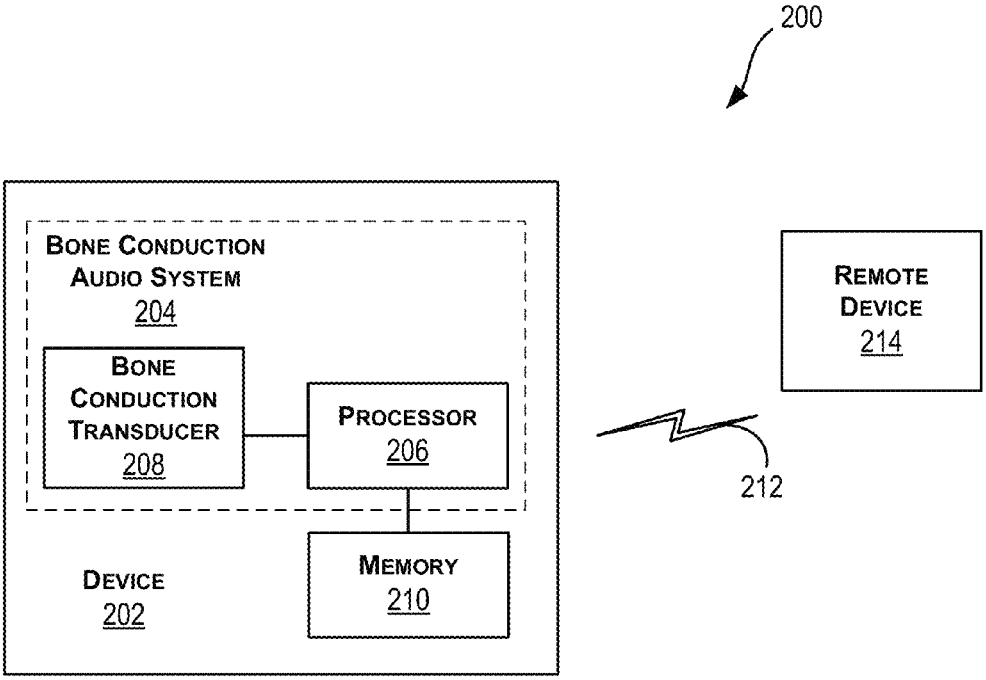
FIG. 2 is a simplified illustration of an example wearable system configured for bone-conduction audio.

FIG. 2 illustrates a schematic drawing of an example computing system. In system 200, a device 202 communicates using a communication link 212 (e.g., a wired or wireless connection) to a remote device 214. The device 202 can be any type of device that can receive data and display information corresponding to or associated with the data. For example, the device 202 can be a wearable computing system, such as the head-mountable devices 102, 138, 150, and/or 170 described with reference to FIGS. 1A-1E.

The device 202 can include a bone conduction audio system 204 for delivering audio content to a wearer of the device 202. The bone conduction audio system 204 includes a processor 206 and a bone conduction transducer ("BCT") 208. The BCT 208 can be, for example, an embedded device including a vibrating diaphragm configured to vibrate according to input signals. In some examples, the bone conduction audio system 204 includes more than one bone conduction transducer. The BCT 208 (or group of BCTs) can be mounted to a frame portion of the device 202 and situated to convey vibrations to a bony portion of the wearer's head such that vibrations propagate through the wearer's skull and/or jaw to the wearer's inner ear. The memory 210 can include executable instructions to be carried out via the processor 206. The processor 206 and/or memory 210 can include hardware and/or software implemented functions to interface with a source of audio content and provide suitable electrical driver signals to the BCT 208 (or group of BCTs).

The processor 206 and/or memory 210 can be configured to receive data from a remote device 214 via wired and/or wireless signals 212. The processor 206 and/or memory 210 can be configured to generate driver signals for the BCT 208 based on the received data signals 212. The processor 206 can be, for example, a micro-processor, a digital signal processor, etc.

The remote device 214 can be a computing device or transmitter configured to transmit data 212 to the device 202. For example, the remote device 214 can be a laptop computer, a mobile telephone, a tablet computing device, etc. The remote device 214 and the device 202 can each include appropriate hardware to allow for generating and receiving the communication signals 212, such as processors, transmitters, receivers, antennas, etc.

In FIG. 2, the communication link between the device 202 and the remote device 214 is illustrated as a wireless connection; however, wired connections can also be used. For example, the communication link providing the signals 212 can be achieved by a wired serial bus such as a universal serial bus or a parallel bus. A wired connection can be a proprietary connection as well. The communication link 212 can additionally or alternatively be a wireless connection using, e.g., Bluetooth® radio technology, communication protocols described in IEEE 802.11 (including any IEEE 802.11 revisions), Cellular technology (such as GSM, CDMA, UMTS, EV-DO, WiMAX, or LTE), or Zigbee® technology, among other possibilities. The remote device 214 can be accessible via the Internet and may include a server associated with a particular web service (e.g., social-networking, photo sharing, audio streaming, etc.).

IV. Bone Conduction Transducer with Cantilevered Support Arms

Figure 3A:
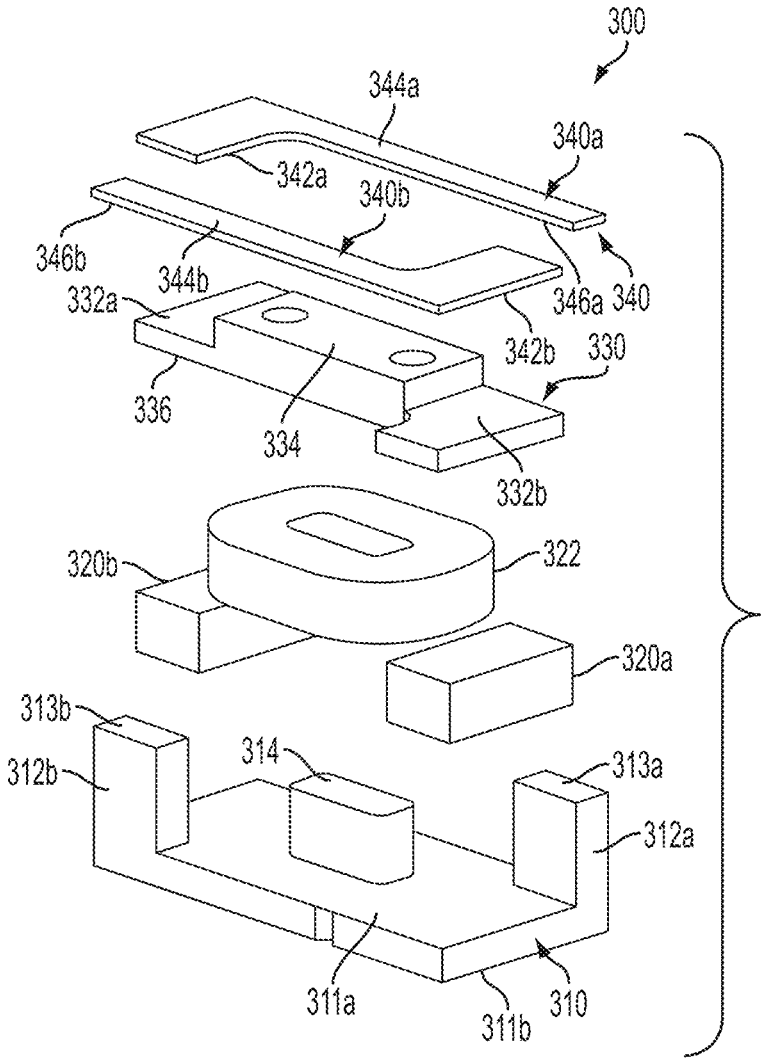
FIG. 3A is an exploded view of a bone conduction transducer including cantilevered support arms suspending a diaphragm.
Figure 3B:
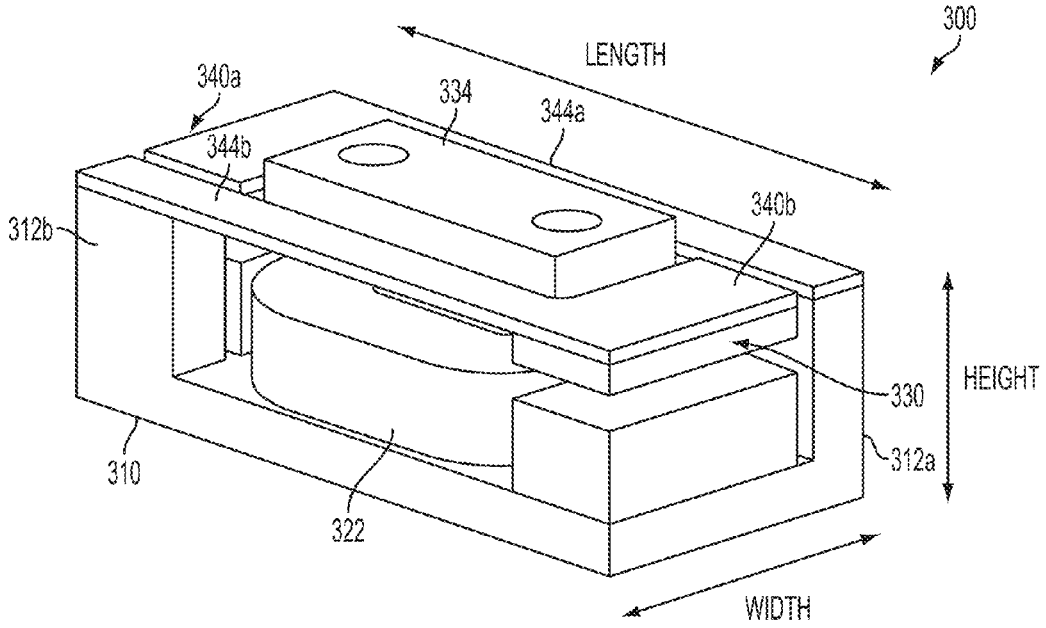
FIG. 3B is an assembled view of the bone conduction transducer in FIG. 3A.

FIG. 3A is an exploded view of a bone conduction transducer ("BCT") 300 including cantilevered support arms 340 suspending a diaphragm 330. FIG. 3B is an assembled view of the BCT 330 shown in FIG. 3A. The BCT 300 includes a frame 310 providing a support structure for an electromagnet with a wire coil 322 and permanent magnets 320*a-b*. A diaphragm 330 is elastically suspended over the wire coil 322 by a pair of cantilevered support arms 340. The support arms 340*a-b* are arranged as leaf springs that each extend adjacent a long side of the diaphragm 330. The support arms 340*a-b* flex to allow the diaphragm 330 to travel toward and away from the electromagnetic wire coil 322 in response to time-changing magnetic fields generated by the wire coil 322.

The frame 310 includes a base platform with a top surface 311*a* and a bottom surface 311*b* opposite the top surface 311*a*. A core 314 extends normal to the top surface 311*a* from a central portion of the base platform to pass through the center of the wire coil 322. The core 314 (and the rest of the frame 310) can be formed of nickel-plated steel or another ferromagnetic material to respond to the time-varying magnetic field created by current in the wire coil 322. The diaphragm 330 can also be formed of a ferromagnetic material (e.g., nickel-plated steel) such that the diaphragm 330 moves under the combined forces of the electromagnetic wire coil 322 and the permanent magnets 320*a-b*.

The permanent magnets 320*a-b* combine to provide a magnetic bias on the diaphragm 330. The permanent magnets 320*a-b* can be arranged with their magnetic fields commonly aligned and oriented in parallel with the axis of the electromagnet coil 322 (i.e., along the direction of the core 314). The permanent magnets 320*a-b* can be situated approximately axially symmetric with respect to the axis of the wire coil 322 (i.e., the core 314) such that the magnetic field contributions provided by each of the permanent magnets 320*a-b* are approximately equal at the center of the wire coil 322. For example, the permanent magnets 320*a-b* can be situated on the top surface 311*a* of the base platform of the frame 310 on opposing sides of the wire coil 322. Where the diaphragm 330 is a ferromagnetic material, such as, for example, nickel-plated steel, the bias from the permanent magnets 320*a-b* magnetizes diaphragm 330 with an opposite (attractive) magnetic field roughly aligned along the core 314 (at the midpoint of the two permanent magnets 320*a-b*). The induced magnetization of the diaphragm 330 due to the permanent magnets 320*a-b* allows the diaphragm 330 to react to time varying magnetic fields generated via the electromagnetic wire coil 322.

It is noted that the present disclosure describes an arrangement of the BCT 300 with two permanent magnets (e.g., the permanent magnets 320*a-b*), however the magnetic bias of the diaphragm 330 can be provided by one or more permanent magnets connected to the frame 310. For example, in some embodiments, a magnetic bias can be provided by three permanent magnets arranged approximately axially symmetrically around the core 314 of the electromagnetic wire coil 322. Moreover, the permanent magnets need not be mounted to the top surface 311*a* of the frame platform, and can be additionally or alternatively mounted to the bottom surface 311*b*, for example.

In addition to the core 314, the frame 310 includes two struts 312*a-b* that extend normal to the top surface 311*a* of the base platform. The struts 312*a-b* can be situated so as to originate from opposing ends of the base platform of the frame 310. Where the base platform is rectangular in shape with four corners, the first strut 312*a* extends perpendicular to the top surface 311*a* from one corner of the rectangle while the second strut 312*b* extends from an opposite corner (i.e., a non-adjacent corner). The struts 312*a-b* each provide a secure mounting point for one of the flexible support arms 340*a-b*. In combination, the struts 312*a-b* anchor one end of each of the flexible support arms 340*a-b* to the frame 310. The opposite end of each of the support arms 340*a-b* is connected to the diaphragm 330 to allow the diaphragm 330 to vibrate under force of the time-changing magnetic field generated by the electromagnetic coil 322.

It is noted that the struts 312*a-b* illustrate one example configuration to mechanically connect the support arms 340*a-b* to the frame 310 such that the diaphragm 330 is elastically suspended with respect to the frame 310. However, other configurations can be employed to elastically suspend the diaphragm 330 with respect to the frame 310. For example, the frame 310 can additionally or alternatively include sidewalls that extend perpendicularly from the top surface 311*a* of the base platform and terminate with a top surface suitable for mounting the support arms 340*a-b*. In some examples, sidewalls can be integrally formed to form sides adjacent each of the magnets 320*a-b*. In some examples, support arms for elastically suspending the diaphragm 330 can be formed with a transverse mounting surface to overlap with respective top surfaces of such sidewalls.

A. Cantilevered Flexible Support Arms

Each of the support arms 340*a-b* includes a leaf spring extension 344*a-b* terminating at one end with a frame mount end 346*a-b*, and terminating at the opposite end with an overlapping diaphragm connection 342*a-b*. On the first support arm 340*a*, the leaf spring extension 344*a* can be formed of a metal, plastic, and/or composite material and has an approximately rectangular cross-section with a height smaller than its width. For example, the approximately rectangular cross section can have rounded corners between substantially straight edges, or can be a shape that lacks straight edges, such as an ellipse or oval with a height smaller than its width. Due to the smaller height, the support arm 340*a* flexes more readily in a direction transverse to its cross-sectional height than its width, such that the support arm 340*a* provides flexion (i.e., movement) in a direction substantially transverse to its cross-sectional height, without allowing significant movement in a direction transverse to its cross-sectional width.

In some embodiments, the cross-sectional height and/or width of the support arms 340*a-b* can vary along the length of the support arms 340*a-b* in a continuous or non-continuous manner such that the support arms 340*a-b* provide desired flexion. For example, the cross-sectional height and/or width of the support arms 340*a-b* can be gradually tapered across their respectively lengths to provide a change in thickness from one end to the other (e.g., a variation in thickness of 10%, 25%, 50%, etc.). In another example, the cross-sectional height and/or width of the support arms 340*a-b* can be relatively small near their respective mid-sections in comparison to their respective ends (e.g., a mid-section with a thickness and/or width of 10%, 25%, 50%, etc. less than the ends). Changes in thickness (i.e., cross-sectional height) and/or width adjust the flexibility of the support arms 340*a-b* and thereby change the frequency and/or amplitude response of the diaphragm 330.

Thus, the leaf spring extension 344*a* can allow the diaphragm 330 to travel toward and away from the wire coil 322 (e.g., parallel to the orientation of the core 314), without moving substantially side-to-side (e.g., perpendicular to the orientation of the core 314). The leaf spring extension 344*b* similarly allows the diaphragm 330 to elastically travel toward and away from the wire coil 322. The frame mount ends 346*a-b* can be a terminal portion of the leaf spring extensions 340*a-b* that overlaps the struts 312*a-b* when the BCT 330 is assembled. The frame mount ends 346*a-b* are securely connected to the respective top surfaces 313*a-b* of the struts 312*a-b* to anchor the support arms 340*a-b* to the frame 310. The opposite ends of the support arms 340*a-b* extend transverse to the length of the leaf spring extensions 344*a-b* to form the overlapping diaphragm mounts 342*a-b*. In some embodiments, the leaf spring extensions 344*a-b* can resemble the height of an upper-case letter "L" while the respective transverse-extended overlapping diaphragm mounts 342*a-b* resemble the base. In some embodiments, such as where the frame 310 additionally or alternatively includes sidewalls for mounting the support arms 340*a-b*, the support arms 340*a-b* can resemble an upper-case letter "C," with leaf spring extensions formed from the mid-section of the "C" and the bottom and top transverse portions providing mounting surfaces to the diaphragm 330 and the side walls, respectively.

The diaphragm 330 is situated as a rectangular plate situated perpendicular to the orientation of the electromagnet core 314 with extending mounting surfaces 332*a-b*. The diaphragm 330 includes an outward vibrating surface 334 and opposite coil-facing surface 336, and mounting surfaces 332*a-b* extending outward from the vibrating surface 334. The mounting surfaces 332*a-b* can be in a parallel plane to the vibrating surface 334, with both in a plane approximately perpendicular to the orientation of the core 314. The mounting surfaces 332*a-b* interface with the overlapping diaphragm mounts 342*a-b* to elastically suspend the diaphragm 330 over the electromagnetic coil 322.

In some embodiments, the vibrating surface 334 is rectangular and oriented in approximately the same direction as the base platform of the frame 310. The mounting surfaces 332*a-b* can optionally project along the length of the rectangular diaphragm 330 to underlap the transverse-extended overlapping diaphragm mounts 342*a-b* of the support arms 340*a-b*. The mounting surfaces 332*a-b* can optionally project along the width of the rectangular diaphragm 330 to allow the support arms 340*a-b* to overlap the mounting surfaces 332*a-b* on a portion of the leaf-spring extensions 344*a-b* in addition to the transverse-extended overlapping diaphragm mounts 342*a-b*.

Furthermore, the two support arms 340*a-b* are connected to opposite ends of the diaphragm 330 (via the overlapping diaphragm mounts 342*a-b*) so as to balance torque generated on the diaphragm 330 by the individual support arms 340*a-b*. That is, each of the support arms 340*a-b* are connected to the diaphragm 330 away from its center-point, but at opposing locations of the diaphragm 330 so as to balance the resulting torque on the diaphragm 330.

When assembled, the first support arm 340*a* is connected to the frame 310 at one end (346*a*) via the first strut 312*a*, and the leaf spring extension 344*a* is projected adjacent the length of the diaphragm 330. The overlapping diaphragm mount 342*a* of the first support arm 340*a* connects to the diaphragm 330 at the mounting surface 332*a*. One edge of the mounting surface 332*a* is situated adjacent the second strut 312*b*, but the opposite end can extend along the width of the diaphragm 330 to underlap the overlapping diaphragm mount 342*a*. Similarly, the second support arm 340*b* is connected to the frame 310 at one end (346*b*) via the second strut 312*b*, and the leaf spring extension 344*b* is projected adjacent the length of the diaphragm 330. The overlapping diaphragm mount 342*a* of the first support arm 340*a* connects to the diaphragm 330 at the mounting surface 332*a*. One edge of the mounting surface 332*b* is situated adjacent the first strut 312*a*, but the opposite end can extend along the width of the diaphragm 330 to underlap the overlapping diaphragm mount 342*b*. To allow for movement of the diaphragm 330 via flexion of the leaf spring extensions 344*a-b* of the support arms 340*a-b*, each of the support arms 340*a-b* and the diaphragm 330 are free of motion-impeding obstructions with the frame 310, wire coil 322 and/or permanent magnets 320*a-b*.

B. Operation of the Bone Conduction Transducer

In operation, electrical signals are provided to the BCT 300 that are based on a source of audio content. The BCT 300 is situated in a wearable computing device such that the vibrations of the diaphragm 330 are conveyed to a bony structure of a wearer's head (to provide vibrational propagation to the wearer's inner ear). For example, with reference to FIG. 2, the processor 206 can interpret signals 212 from the remote device 214 communicating a data indicative of audio content (e.g., a digitized audio stream). The processor 206 can generate electrical signals to the wire coil 322 to create a time-changing magnetic field sufficient to vibrate the diaphragm 330 to create vibrations in the wearer's inner ear corresponding to the original audio content communicated via the signals 212. For example, the electrical signals can drive currents in alternating directions through the wire coil 322 so as to create a time-changing magnetic field with a frequency and/or amplitude sufficient to create the desired vibrations for perception in the inner ear.

The vibrating surface 334 of the diaphragm 330 can optionally include mounting points, such as, for example, threaded holes, to allow for securing an anvil to the BCT 300. For example, an anvil with suitable dimensions and/or shape for coupling to a bony portion of a head can be mounted to the vibrating surface 334 of the diaphragm 330. The mounting points thereby allow for a single BCT design to be used with multiple different anvils, such as some anvils configured to contact a wearer's temple, and others configured to contact a wearer's mastoid bone, etc. It is noted that other techniques may be used to connect the diaphragm 330 to an anvil, such as adhesives, heat staking, interference fit ("press fit"), insert molding, welding, etc. Such connection techniques can be employed to provide a rigid bond between an anvil and the vibrating surface 334 such that vibrations are readily transferred from the vibrating surface 334 to the anvil and not absorbed in such bonds. In some examples, the diaphragm 330 can be integrally formed with a suitable anvil, such as where a vibrating surface of the diaphragm 330 is exposed to be employed as an anvil for vibrating against a bony portion of the wearer's head.

In some embodiments of the present disclosure, the support arms 340*a-b* are cantilevered along the length of the diaphragm 330 (i.e., along the longest dimension of the approximately rectangular plate forming the vibrating surface 334). One end of the cantilevered support arm 340*a* is connected to the frame 310 via the strut 312*a* (at the connection point 346*a*) near one side of the diaphragm 330, and the opposite end of the support arm 340*a* is connected to the diaphragm 330 near the opposite end of the diaphragm 330 via the support surface 332*a* and the overlapping diaphragm mount 342*a*. Similarly, one end of the cantilevered support arm 340*b* is connected to the frame 310 via the strut 312*b* (at the connection point 346*b*) near one side of the diaphragm 330, and the opposite end of the support arm 340*b* is connected to the diaphragm 330 near the opposite end of the diaphragm 330 via the support surface 332*b* and the overlapping diaphragm mount 342*b*. Thus, the two support arms 340*a-b* cross one another on opposite sides of the diaphragm 330 to balance the torque on the diaphragm 330, with one extending adjacent one side of the diaphragm 330, the other extending along the opposite side of the diaphragm 330.

It is noted that the BCT 330 shows the connection between the support arms 340*a-b* and the diaphragm 330 with the support arms 340*a-b* overlapping the diaphragm 330 (e.g., at the overlapping diaphragm mounts 340*a-b*). However, a secure mechanical connection between the support arms 340*a-b* and the diaphragm 330 can also be provided by arranging the diaphragm 330 to overlap the support arms 340*a-b*. In such case, the struts 312*a-b* can optionally be lowered by an amount approximately equal to the thickness of the diaphragm mounting surfaces 332*a-b* to achieve a comparable separation between the diaphragm lower surface 336 and the electromagnetic coil 314.

Some embodiments of the present disclosure provide a compact form factor for a bone conduction transducer while maximizing the length of the elastic components (e.g., the leaf spring extensions 344*a-b* of the support arms 340*a-b*). The performance of the BCT 300 can accordingly be tuned by adjusting the parameters of the support arms 340*a-b* contributing to the elasticity of the diaphragm 330. Generally, materials selection of the support arms 340*a-b* can be chosen to achieve different frequency and/or amplitude responses for the BCT 300. For example, the support arms 340*a-b* can be formed of steel (including a variety of grades of stainless steel), aluminum, other metals and alloys, plastics, carbon composites, etc. to provide varying frequency and/or amplitude responses. Furthermore, even for a particular material, such as stainless steel, for example, frequency and/or amplitude response can be adjusted by modifying the grade (e.g., purity) and/or manufacturing processes (e.g., tempering) of such material. The thickness of the support arms (i.e., the cross-sectional height) and/or the width of the support arms can be adjusted to provide varying frequency and/or amplitude responses. For example, an increased cross-sectional height of the support arms 340*a-b* results in a "stiffer" response, that is, less amplitude variations for a given time-varying magnetic field generated by the wire coil 322. Selecting from among available materials and dimensions allows for tuning the BCT 300 to achieve a desired amplitude and/or frequency response.

In some embodiments, the support arms 340*a-b* are themselves non-magnetic to prevent the support arms 340*a-b* from contributing to the response of the time-varying magnetic fields produced at the electromagnetic coil 322. For example, the support arms 340*a-b* can be formed of a non-magnetic stainless steel, carbon fiber, plastic, and/or glass-fiber composites, etc.

C. Laser Spot Weld Assembly of the Bone Conduction Transducer

Figure 4B:
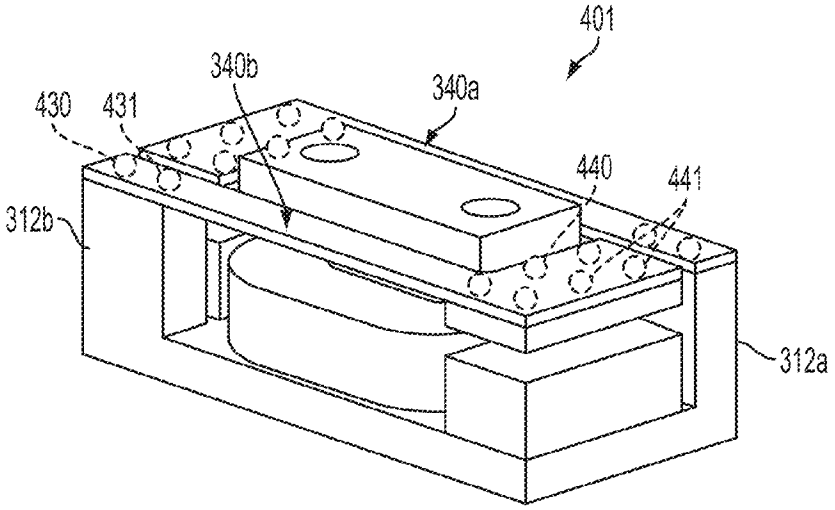
FIG. 4B shows example spot welding locations to assemble the bone conduction transducer according to another embodiment.
Figure 4A:
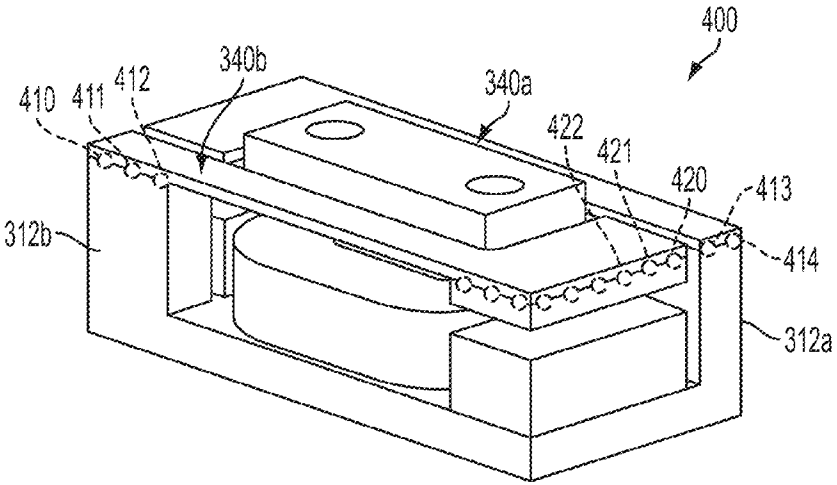
FIG. 4A shows example spot welding locations to assemble the bone conduction transducer according to one embodiment.

FIG. 4A shows example spot welding locations to assemble a bone conduction transducer 400 according to one embodiment. The bone conduction transducer 400 is assembled by laser welding the support arms 340*a-b* to the struts 312*a-b* of the frame 310 and the diaphragm 330 at a series of spots along the exposed edges of the interface between the support arms 340*a-b* and the struts 312*a-b* and diaphragm 330. For illustrative purposes, the second support arm 340*b* is shown with three laser weld spots 410, 411, 412 along the outer edge where the second support arm end 346*b* meets the top surface 313*b* of the second strut 312*b*. Laser spot welds 413, 414 are indicated along the exposed edges of the interface between the first support arm end 346*a* meets the top surface 313*a* of the first strut 312*a*. Similarly, laser spot welds 420, 421, 422, etc. are indicated along the exposed edges of the interface between the overlapping diaphragm mount 342*b* and the diaphragm mounting surface 332*b*. During assembly of the BCT 400, a laser sufficient to generate heat for laser welding is directed to the regions indicated as laser weld spots 410-422, etc. It is noted that the view provided in FIG. 4A illustrates one visible side of the BCT 400, and that an edge laser weld assembly would include applying laser welds along all exposed edges of interfaces between the support arms 340*a-b*, the struts 312*a-b*, and the diaphragm 330, including edges not visible in FIG. 4A.

FIG. 4B shows example spot welding locations to assemble a bone conduction transducer 401 according to another embodiment. The bone conduction transducer 401 is assembled by laser welding the support arms 340*a-b* to the struts 312*a-b* and the diaphragm 330 by laser welding the top exposed surface of the support arms 340*a-b*. The support arms 340*a-b* are sufficiently thin that a laser weld spot applied to the top surface can effectively securely connect the support arms 340*a-b* to the diaphragm 330 and/or struts 312*a-b* located below. For illustrative purposes, the second support arm 340*b* is shown with two laser weld spots 430, 431 where the second support arm end 346*b* meets the top surface 313*b* of the second strut 312*b*. The laser weld spots 430, 431 are generated by directing a laser source to the side of the second support arm end 346*b* opposite the side facing the top surface 313*b* of the second strut 312*b*. Heat generated at the laser weld spots 430, 431 welds the second support arm end 346*b* to the second strut 312*b*. Similarly, laser spot welds 440, 441, etc. are indicated along the exposed top surface of the overlapping diaphragm mount 342*b* opposite the side facing the diaphragm mounting surface 332*b*. Heat generated at the laser weld spots 440, 441 welds the second support arm 340*b* to the diaphragm 330. Similarly, laser weld spots are indicated to connect the first support arm 340*a* to the first strut 312*a* and diaphragm mounting surface 332*a*.

In some embodiments, the support arms 340*a-b* can be securely connected to the struts 312*a-b* and/or diaphragm 330 with a combination of laser welds along exposed edges, on the surface of the support arms 340*a-b* or a combination thereof. Furthermore, some embodiments of the present disclosure provide for the support arms 340*a-b* to be securely connected to the struts 312*a-b* and/or diaphragm 330 without employing a laser weld connection (e.g., by adhesives, heat staking, interference fit ("press fit"), insert molding, other forms of welding, etc.).

In some embodiments, the connection between the support arms 340*a-b* and the struts 312*a-b* can optionally be non-uniform across the top surfaces 313*a-b* of the struts 312*a-b*. For example, to adjust ("tune") the frequency and/or amplitude response of the support arms 340*a-b*, the support arms 340*a-b* can be connected only near the far end of the support arm ends 346*a-b* (e.g., near the laser weld point 410 in FIG. 4A) and the remainder of the interfaces with the top surfaces 313*a-b* can be left unconnected to allow for additional travel of the diaphragm 330. Alternatively, the support arms 340*a-b* can be connected only nearest the edge of the struts 312*a-b* further from the far end of the support arm ends 346*a-b* (e.g., near the laser weld point 412 in FIG. 4A) and the remainder of the interfaces with the top surfaces 313*a-b* can be left unconnected to allow for additional spring in the diaphragm 330.

Figure 5:
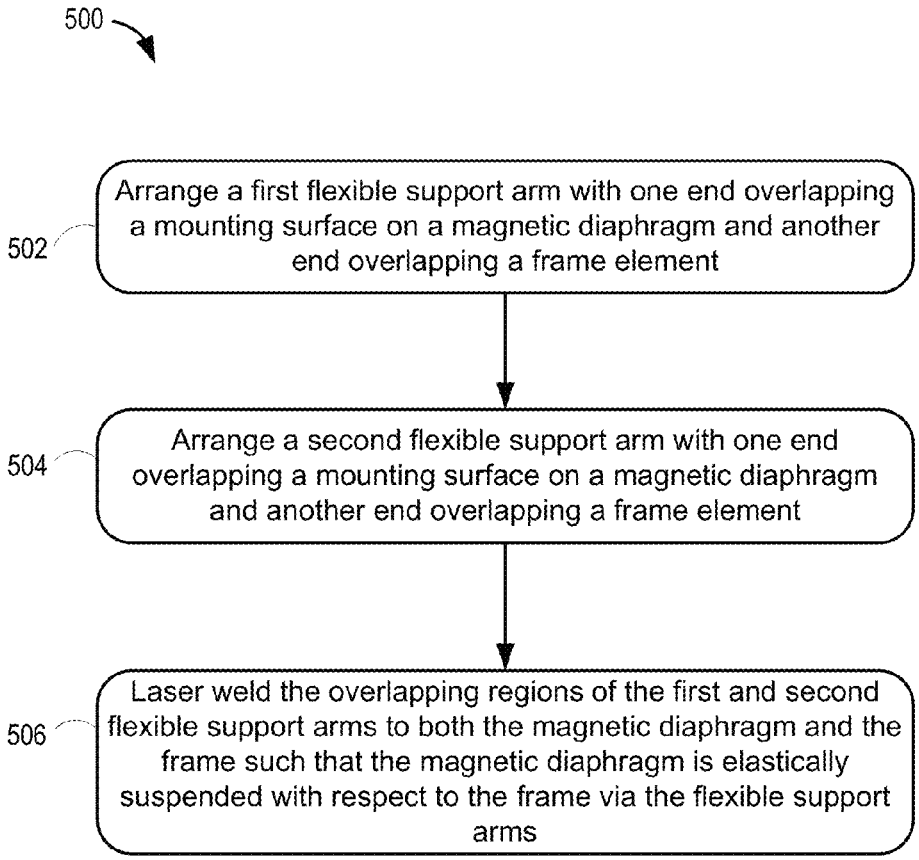
FIG. 5 shows an example process for assembling the bone conduction transducer according to an embodiment.

FIG. 5 shows an example process 500 for assembling the bone conduction transducer according to an embodiment. A first flexible support arm is arranged with one end overlapping a mounting surface on a magnetic diaphragm and another end overlapping a frame element (502). A second flexible support arm is arranged with one end overlapping a mounting surface on a magnetic diaphragm and another end overlapping a frame element (504). The frame element on which the flexible support arms are overlaid can be, for example, a strut feature similar to the struts 312*a-b*, an integrally formed sidewall similar to the discussion of sidewalls in connection with FIG. 3 above, etc. The two support arms can be connected to opposing sides of the magnetic diaphragm (e.g., the diaphragm mounting surfaces 332*a*, 332*b*). The support arms can be situated with their respective ends overlaid on the magnetic diaphragm and the frame elements at overlapping regions of the support arms. It is noted that the support arms (e.g., the support arms 340*a-b*) can be arranged in any order (e.g., first arm, then second arm; second arm, then first arm; or simultaneously).

Once arranged, the support arms can be laser welded to both the magnetic diaphragm and the frame such that the magnetic diaphragm is elastically suspended with respect to the frame via the flexible support arms (506). A laser source sufficient to generate heat for laser welding can be directed to the overlapping regions of the flexible support arms to form one or more laser weld spots that couple the support arms to the magnetic diaphragm and the frame. For example, laser weld spots can be created by directing the laser source to an exposed top surface of the flexible support arms (e.g., a surface opposite the surface facing the magnetic diaphragm and/or frame elements) to form weld spots by heating through the overlapping regions of the flexible support arms, such as the laser weld spots described in connection with FIG. 4B above. Additionally or alternatively, laser weld spots can be created by directing the laser source to an exposed edge of the flexible support arms (e.g., a side edge immediately adjacent a surface facing the magnetic diaphragm and/or frame elements) to form weld spots by side heating the edges of the overlapping regions of the flexible support arms, such as the laser weld spots described in connection with FIG. 4A above.

As noted above, in some embodiments, the support arms can be arranged according to blocks 502, 504 simultaneously. For example, with reference to the example support arms in FIGS. 3A and 3B, the pair of support arms 340*a-b* can be joined, during alignment, by one or more removable tabs integrally formed with the support arms, such that the pair of support arms is moved into position as a single unit to overlap the mounting surfaces 332*a-b* of the magnetic diaphragm 330 and the frame elements. For example, the pair of support arms 340*a-b* can be formed by stamping a piece of sheet metal (or other metal) to cut out both support arms 340*a-b* simultaneously while leaving one or more tabs connecting the two support arms. For example, tabs can be cut out such that respective opposing ends of the support arms 340*a-b* are connected together to maintain the geometry of the support arm configuration (e.g., the spacing between the support arms, the co-planar relationship of the support arms, etc.). Thus, in one example, the support arm end 346*a* of the first support arm 340*a* can be connected to the overlapping diaphragm mount 346*b* of the second support arm 340*b* through an integrally formed tab, and the support arm end 346*b* of the second support arm 340*b* can be connected to the overlapping diaphragm mount 346*a* of the first support arm 340*a* through an integrally formed tab. In such an example, the integrally formed tabs can complete a four-sided frame formed by the two support arms 340*a-b* to rigidly hold the configuration of the two support arms 340*a-b* relative to one another while they are positioned ("arranged") and laser welded in place. Once the support arms 340*a-b* are laser welded in place, such as in block 506 above, the alignment tabs, if present, can be removed (e.g., by breaking the tabs along score lines, by cutting the tabs with an appropriate tool, etc.). For example, score lines can be formed by an appropriate relief in the die that stamps the pair of support arms and the alignment tabs.

In some embodiments, such tabs can be stamped from the same sheet of metal (or other material) as the support arms. In comparison to forming the first support arm from one sheet of metal and the second support arm from another sheet of metal, forming the pair of support arms from adjacent regions of the same sheet of metal. (e.g., by stamping the sheet of metal to form support arms in the configuration and alignment desired once assembled) results in pairs of support arms with matched properties, such as thickness, material chemistry, flexibility, etc. Creating support arms with matched properties ensures that the assembled bone conduction transducer is balanced and the magnetic diaphragm vibrates back and forth without biasing one side or the other.

In some embodiments, such alignment tabs are situated to protrude from the body of the assembled bone conduction transducer without interfering with other features in the transducer (such as sidewalls and/or struts of the frame, the magnetic diaphragm, the permanent magnets, etc.). Such alignment tabs can protrude, for example, transverse to the direction of the leaf spring extensions 344*a-b* (i.e., the "long" dimension of the respective support arms), and outward from the transducer 300 (i.e., away from the middle of the transducer 300. Such a configuration may be employed, for example, when the support arms are implemented in a C-shaped configuration and connect to the frame along a base of the C that is transverse to the leaf-spring section and overlaps a sidewall of the frame. In such an example, an alignment tab can emerge from the end of the C-shaped base of one support arm and join the other support arm along the middle portion of the C shape, near the end overlapping the magnetic diaphragm.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. An apparatus comprising:

a frame having a first side and a second side opposite the first side, wherein the first side and the second side of the frame are opposing sides that bound a longest dimension of a transducer, the transducer comprising:

an electromagnet including a conductive coil surrounding a ferrous core, wherein the conductive coil is configured to be driven by an electrical input signal to generate magnetic fields, wherein the electromagnet is mounted to the frame;

a magnetic diaphragm that is configured to mechanically vibrate in response to the generated magnetic fields; and a first flexible support arm and a second flexible support arm that elastically couple the magnetic diaphragm to the frame such that the magnetic diaphragm vibrates with respect to the frame when the electromagnet is driven by the electrical input signal, wherein the first flexible support arm extends from the frame at a location proximate the first side of the frame, to a side of the magnetic diaphragm proximate the second side of the frame, wherein the second flexible support arm extends from the frame at a location proximate the second side of the frame, to a side of the magnetic diaphragm proximate the first side of the frame, and wherein each of the first and second flexible support arms extend along the longest dimension of the transducer, adjacent respective opposing sides of the magnetic diaphragm that are free of connection to either of the flexible support arms.

2. The apparatus according to claim 1, wherein the first and second flexible support arms each include an extended leaf spring with an approximately rectangular cross-section having a width greater than a height such that the flexible support arms flex transverse to their respective cross-sectional heights during vibration of the magnetic diaphragm.

3. The apparatus according to claim 1, wherein the first and second flexible support arms are securely connected to the magnetic diaphragm via respective mounting plates overlapping portions of the magnetic diaphragm protruding from opposing sides of the magnetic diaphragm, wherein the mounting plates each extend transverse to a flexible portion of the respective flexible support arms that extend adjacent the respective opposing sides of the magnetic diaphragm that are free of connection to either of the flexible support arms.

4. The apparatus according to claim 1, wherein each of the first and second flexible support arms are connected to the frame via struts or sidewalls protruding from a base of the frame in a direction parallel an axis of the electromagnet.

5. The apparatus according to claim 1, further comprising:

first and second permanent magnets arranged with substantially parallel magnetic axes and securely connected to the frame on opposing sides of the electromagnet to provide a magnetic bias force on the magnetic diaphragm.

6. The apparatus according to claim 1, wherein the first and second flexible support arms are non-magnetic.

7. The apparatus according to claim 1, wherein the first and second pair of cantilevered flexible support arms are securely coupled to at least one of the frame or the magnetic diaphragm via one or more laser weld spots.

8. A wearable computing system comprising:

a support structure, wherein one or more portions of the support structure are configured to contact a wearer;

an audio interface for receiving an audio signal; and a frame having a first side and a second side opposite the first side, wherein the first side and the second side of the frame are opposing sides that bound a longest dimension of a vibration transducer, the vibration transducer including:

an electromagnet including a conductive coil surrounding a central core, wherein the conductive coil is configured to be driven by an electrical input signal to generate magnetic fields, wherein the electromagnet is mounted to the frame;

a magnetic diaphragm that is configured to mechanically vibrate in response to the generated magnetic fields; and a first flexible support arm and a second flexible support arm that elastically couple the magnetic diaphragm to the frame such that the magnetic diaphragm vibrates with respect to the frame when the electromagnet is driven by the electrical input signal, wherein the first flexible support arm extends from the frame at a location proximate the first side of the frame, to a side of the magnetic diaphragm proximate the second side of the frame, wherein the second flexible support arm extends from the frame at a location proximate the second side of the frame, to a side of the magnetic diaphragm proximate the first side of the frame, and wherein each of the first and second flexible support arms extend along the longest dimension of the vibration transducer, adjacent respective opposing sides of the magnetic diaphragm that are free of connection to either of the flexible support arms; and wherein the vibration transducer is embedded in the support structure and configured to vibrate based on the audio signal so as to provide information indicative of the audio signal to the wearer via a bone structure of the wearer.

9. The wearable computing system according to claim 8, wherein the support structure includes side-arms configured to rest on ears of the wearer and a nose bridge configured to rest on a nose of the wearer.

10. The wearable computing system according to claim 8, wherein the one or more portions of the support structure are configured to contact the wearer via at least one of: a location on a back of an ear of the wearer, a location on a front of the ear of the wearer, a location near a temple of the wearer, a location on or above a nose of the wearer, or a location near an eyebrow of the wearer.

11. The wearable computing system according to claim 8, wherein the vibration transducer is one of a plurality of similar vibration transducers, wherein at least one of the plurality of similar vibration transducers is embedded in a side-arm of the support structure configured to rest on an ear of the wearer.

12. The wearable computing system according to claim 11, wherein the plurality of similar vibration transducers are each at least partially embedded in the support structure.

13. The wearable computing system according to claim 8, wherein the first and second flexible support arms each include an extended leaf spring with an approximately rectangular cross-section having a width greater than a height such that the flexible support arms flex transverse to their respective cross-sectional heights during vibration of the magnetic diaphragm.

14. The wearable computing system according to claim 8, wherein the first and second flexible support arms are securely connected to the magnetic diaphragm via respective mounting plates overlapping portions of the magnetic diaphragm protruding from opposing sides of the magnetic diaphragm, wherein the mounting plates each extend transverse to a flexible portion of the respective support arms arranged adjacent the respective opposing sides of the magnetic diaphragm that are free of connection to either of the flexible support arms.

15. The wearable computing system according to claim 8, wherein each of the first and second flexible support arms are connected to the frame via struts or sidewalls protruding from a base of the frame in a direction parallel an axis of the electromagnet.

16. The wearable computing system according to claim 8, further comprising:

first and second permanent magnets arranged with substantially parallel magnetic axes and securely connected to the frame on opposing sides of the electromagnet to provide a magnetic bias force on the magnetic diaphragm.

* * * * *